United States Patent [19]

Fragale

[11] 4,057,309

[45] Nov. 8, 1977

[54] CLOTHES HAMPER

[76] Inventor: Eleanor M. Fragale, 4931 Fairview, St. Louis, Mo. 63139

[21] Appl. No.: 702,919

[22] Filed: July 6, 1976

[51] Int. Cl.[2] ..... A47B 81/00; A47B 43/02

[52] U.S. Cl. ..... 312/290; 312/214; 312/259

[58] Field of Search ..... 312/259, 261, 260, 262, 312/290, 214

[56] References Cited

U.S. PATENT DOCUMENTS

| | | | |
|---|---|---|---|
| 1,731,325 | 10/1929 | Stevens | 312/290 |
| 2,814,542 | 11/1957 | Gleitsman | 312/290 |
| 2,895,782 | 7/1959 | Fragale | 312/290 |
| 3,628,842 | 12/1971 | Wright | 312/259 |
| 3,872,342 | 3/1975 | Dankert | 312/290 |
| 3,957,320 | 5/1976 | Walter | 312/259 |
| 3,966,286 | 6/1976 | Groseclose | 312/262 |

FOREIGN PATENT DOCUMENTS

| | | | |
|---|---|---|---|
| 685,156 | 7/1930 | France | 312/290 |

*Primary Examiner*—Paul R. Gilliam
*Assistant Examiner*—Alex Grosz
*Attorney, Agent, or Firm*—Polster, Polster and Lucchesi

[57] ABSTRACT

A clothes hamper has a central horizontal partition-shelf defining an upper, open-topped compartment and a lower, open-fronted compartment, a plurality of upper, open-topped, free-standing sub-containers removably mounted on the partition shelf, and a plurality of lower, open-topped, free-standing sub-containers mounted in the hamper below the partition for movement into and out of the hamper through a front wall opening. Preferably the hamper is made of corrugated board and the sub-containers are made from unitary blanks of paperboard.

9 Claims, 15 Drawing Figures

CLOTHES HAMPER

BACKGROUND OF THE INVENTION

Conventional clothes hampers have largely gone out of style with the almost universal use of the automatic washer. Because of the time involved in doing one wash load, and the fact that the average household generates between five and six different types of wash loads, plus some doubles of the same type, most people find it more convenient to wash several times a week. If all of the wash is to be done in one day, it must be sorted and left in piles all over the basement or kitchen until the wash is done, and if six or seven loads are to be done, it will take all day provided one is at hand to put in the next load every 45 minutes or so.

The users of automatic washers who prefer to wash a load or two at a time throughout the week have been presented with a problem of sorting. Some keep their sorted laundry in different containers which take up much space and make it difficult for members of the family to put their soiled laundry into the proper container. If one stops to sort laundry for a particular type wash load every time he wishes to wash a load, it is a time-consuming task. There are those who put all of the accumulated laundry in the washer together, which leads to gray, dull-looking clothes.

In applicant's U.S. Pat. No. 2,895,782, provision was made for segregation of clothes of various sorts, but it was still necessary to remove the segregated clothes from the hamper to a bag or laundry basket, if the dirty clothes were to be taken any distance to a wash machine.

One of the objects of this invention is to provide a low-cost, aesthetically pleasing clothes hamper, in which provision is made not only for segregating kinds of clothes, but for providing "built-in" sub-containers, removable from the hamper, by which the segregated clothes can be carried to a wash machine, in wash-load lots.

Another object is to provide a clothes hamper with disposable sub-containers which can be replaced cheaply and easily.

Other objects will become apparent to those skilled in the art in the light of the following description and accompanying drawing.

SUMMARY OF THE INVENTION

In accordance with this invention, generally stated, a clothes hamper is provided which includes a rectangular main container having front, side, back and bottom walls, an open top and a hinged cover for said open top, the front wall having an opening extending substantially from side wall to side wall in its lower part and a central horizontal partition shelf defining an upper, open-topped compartment and a lower, open-fronted compartment. A plurality of upper, open-topped free-standing sub-containers are removably mounted in the upper compartment for insertion into and removal from the compartment vertically, and a plurality of lower, open-topped, free-standing sub-containers are mounted in the lower compartment for movement into and out of the lower compartment laterally through the front wall opening.

In the preferred embodiment, the main container is made of two blanks of corrugated board, fastened together, and a relatively stiff, dent-resistant cover hinged to one of the panels. Each of the sub-containers is preferably made of a unitary blank of paperboard.

The back wall of each of the sub-containers is provided with openings which communicate with openings in the back wall of the main container to provide ventilation.

Each of the sub-containers is preferably dimensioned to accommodate a minimum of a load of clothes of a particular sort, and is provided with hand holds or handles by which it can be carried. Thus, one or more sub-containers can be carried, with its load of clothes, to a wash machine, wherever it may be, without the necessity of transferring the clothes to some other container.

The sub-containers are light, and strong, but inexpensive, and can be replaced if they become lost, damaged, or soiled.

DESCRIPTION OF THE PREFERRED EMBODIMENT

Figure 1:
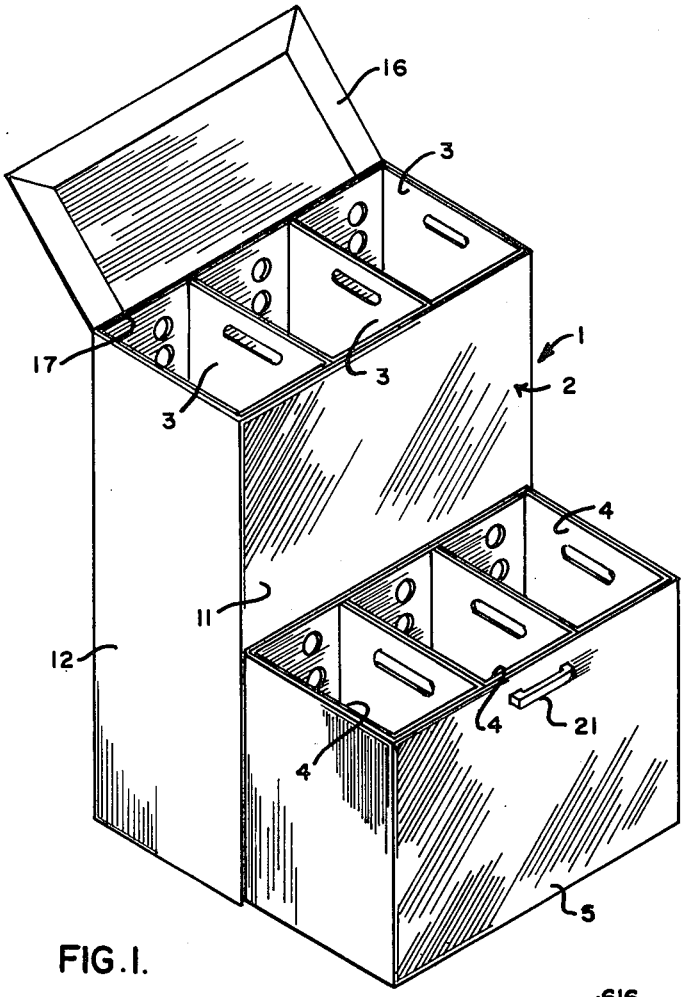
FIG. 1 is a view in perspective of one embodiment of clothes hamper of this invention.
Figure 2:
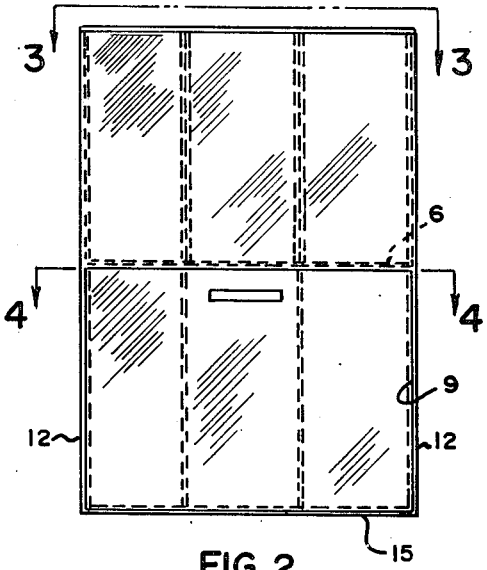
FIG. 2 is a view in front elevation of the hamper shown in FIG. 1, in closed condition.
Figure 3:
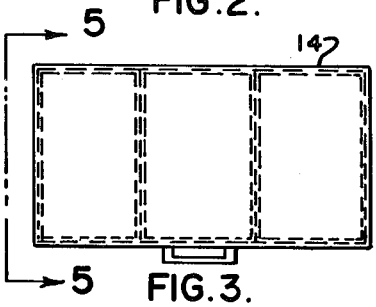
FIG. 3 is a top plan view of the hamper shown in FIG. 1.
Figure 4:
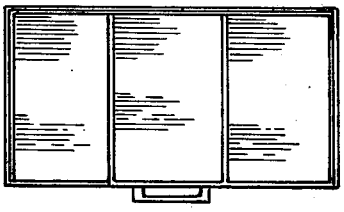
FIG. 4 is a sectional view taken along the line 4—4 of FIG. 2.
Figure 5:
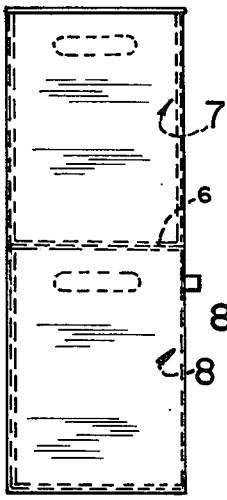
FIG. 5 is a view in side elevation in the direction indicated by the line 5—5 of FIG. 3.

Referring now to FIG. 1 of the drawing for one embodiment of hamper of this invention, reference numeral 1 indicates the complete hamper, which is made up of a main container 2, upper sub-containers 3, and lower sub-containers 4. In this embodiment, the lower sub-containers 4 are in a drawer 5, but, as will be described hereinafter, in the preferred embodiment, the lower sub-containers 4 are fitted into the hamper without the drawer 5.

In all of the embodiments here shown and described, the main container 2 has a front wall 11, side walls 12, a back wall 14, a bottom 15 and a cover 16. The cover 16 is connected to the back wall 14 by a hinge 17, which may be integral with the back wall 14 or the cover 16, or neither.

In all of the embodiments, a central horizontal partition-shelf 6 extends from the front wall 11 to the back wall 14, and divides the hamper into an upper, open-topped compartment 7 and a lower compartment 8 opening through an opening 9 in the front wall 11, extending substantially from one side wall 12 to the other, and from the bottom 15 to the outer edge of the partition-shelf 6.

In the embodiment shown in FIGS. 1 through 5, in which the drawer 5 is provided, a drawer handle 21 is provided. The drawer 5 itself can be made as a conventional open-topped double faced corrugated box.

Figure 6:
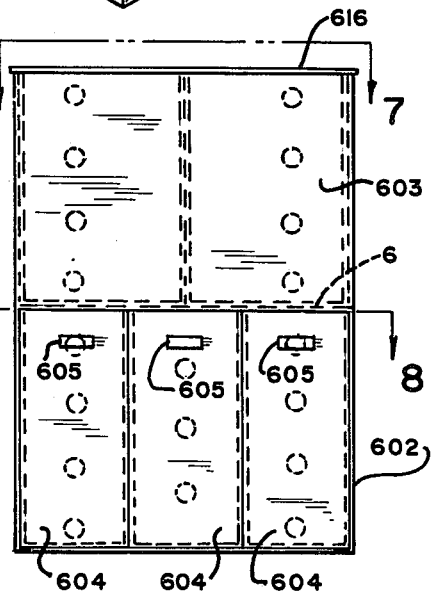
FIG. 6 is a view in front elevation of another embodiment of hamper of this invention.
Figure 7:
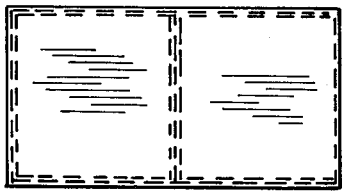
FIG. 7 is a top plan view of the hamper of FIG. 6.

Referring now to FIG. 6, in this embodiment of hamper, the main container can be identical with the main container shown in FIG. 1. The difference between the embodiment shown in FIG. 6 and that shown in FIG. 1 lies in the provision of lower sub-containers 604 which are dimensioned to fit into the hamper without a drawer, the provision of a different type of cover 616, and the provision of two upper sub-containers 603, rather than three upper sub-containers. The main container 602 of this embodiment can be the same as the main container 2, as has been indicated, or a different embodiment, the appearance of the two being substantially the same.

Figure 8:
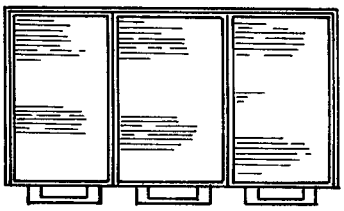
FIG. 8 is a sectional view taken along the line 8—8 of FIG. 6.

In the embodiment of hamper shown in FIG. 6, the lower sub-containers 604 are provided with separate individual handles 605, which may take the form of straps mounted in vertical slots in the front wall of the lower compartment, or of more elaborate handles as illustrated in FIG. 8.

Figure 9:
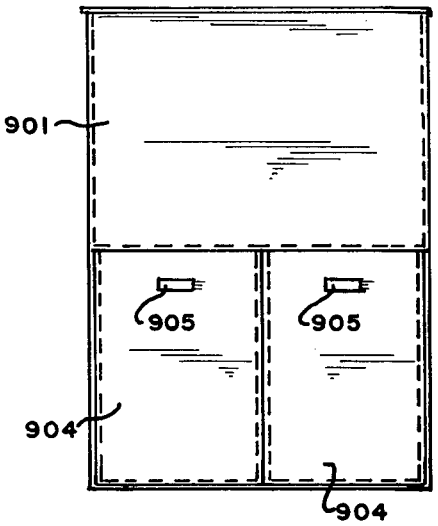
FIG. 9 is a view in front elevation of still another embodiment of hamper of this invention.

Referring now to FIG. 9 for still another embodiment of hamper, 901, the hamper 901 differs from the hamper shown in FIG. 6 in the provision of two, as distinguished from three, lower sub-containers 904, each with a handle 905. Either two, relatively large, upper sub-containers can be provided or more than two, relative smaller, upper sub-containers. The sub-containers in any of the embodiments can be left out or replaced by sub-containers of different sizes.

In the embodiment shown in FIG. 1, in which the drawer 5 is utilized, all of the sub-containers, upper and lower, can be made identical. In those embodiments in which the lower sub-containers are exposed, it is preferred that the outer faces (front walls) of the lower sub-containers be coated or decorated in the same way as the main container, or at least finished attractively. In the embodiment shown in FIG. 1, the drawer 5 should be finished on its front wall, similarly.

Figure 10:
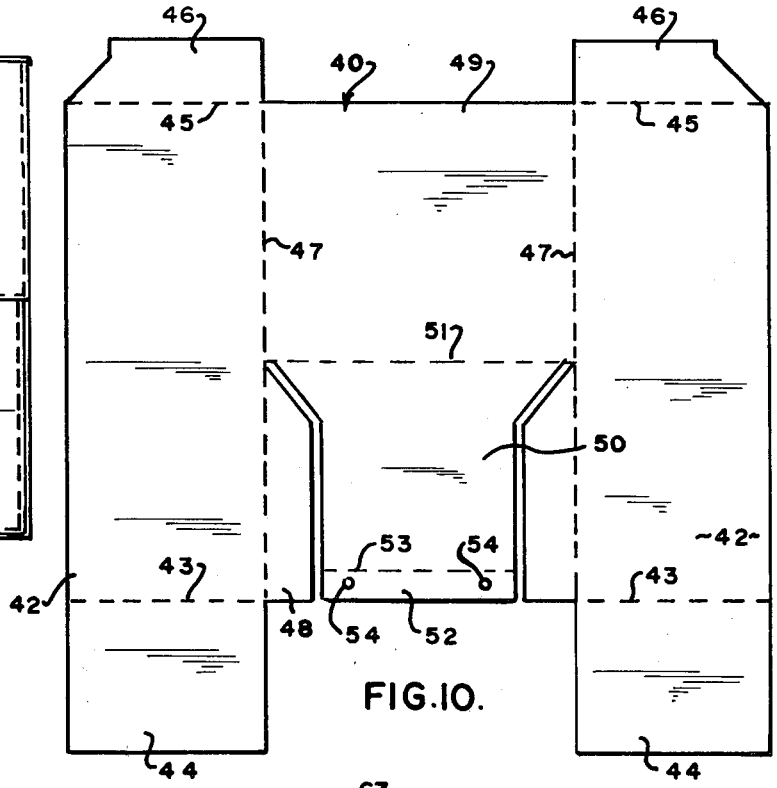
FIG. 10 is a plan view of one embodiment of blank panel by which the main container of a hamper of this invention can be formed.
Figure 11:
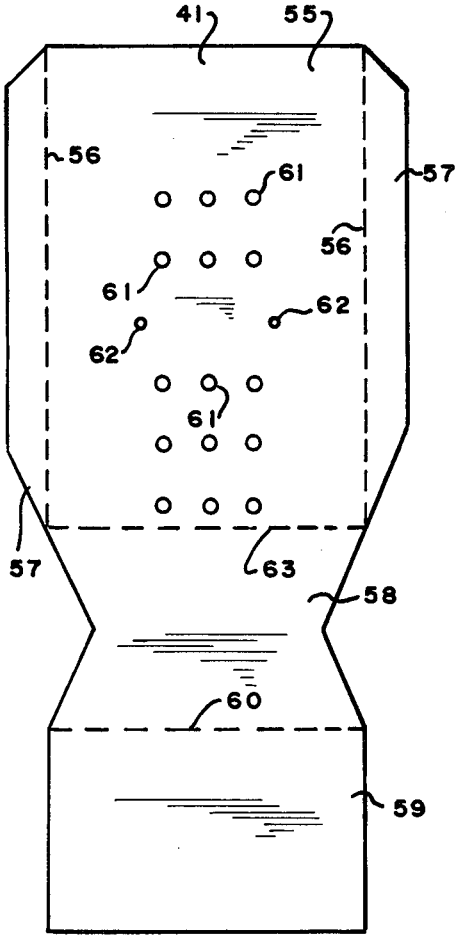
FIG. 11 is a plan view of a second blank panel which, together with the blank shown in FIG. 10 forms all of the main container except the cover.
Figure 12:
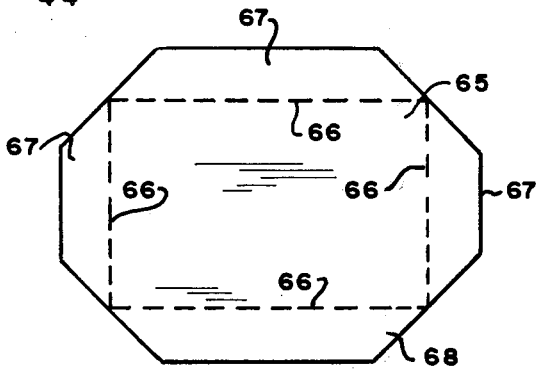
FIG. 12 is a plan view of a blank by which one embodiment of cover or lid of the hamper of this invention can be formed.

In the preferred forms of hamper of this invention, the main container back, front, sides, and partition are formed from two blank panels. Referring to FIGS. 10, 11 and 12 for panel blanks which can be used to make up the main container of the embodiment of hamper shown in FIG. 1, reference numeral 40 indicates a main container blank from which the front, sides, partition and part of the bottom are formed, and reference numeral 41 indicates a main container blank from which the back and most of the bottom are formed.

In the blank 40, side wall panels 42 have at their lower ends transverse fold lines 43 demarking side wall bottom flaps 44. Transverse fold lines 45 mark the boundary of side wall top finishing flaps 46.

Fold lines 47, perpendicular to the fold lines 43 and 45, mark the boundaries of side wall panel opening finishing flaps 48 and a front wall panel 49, which bridges between the side panels 42, between the fold lines 47.

A partition panel 50 is integral with the front wall panel 49 along a fold line 51. At the free end of the partition panel 50 is a partition panel leading flap 52, demarked by a fold line 53. Fastener holes 54 are formed in the leading flap 52.

The main container blank 41 is made up of a back panel 55 along opposition side margins of which are fold lines 56 marking the margins of glue flaps 57. A transverse fold line 63 marks one boundary of an outer bottom flap 58, an opposite boundary of which is marked by a transverse fold line 60, which may be a double line, which in turn marks an attached edge of an inner bottom flap 59.

The back panel 55 is provided with ventilation holes 61, and with spaced, horizontally aligned fastener holes 62, the latter being spaced and sized complementarily to the fastener holes 54 of the partition panel leading flap 52.

Referring now to FIG. 12, a lid or cover blank 65 has fold lines 66 defining a rectangle slightly larger than the rectangular top of the hamper 1. Outboard of the fold lines 66, and integral with the blank, are finishing flaps 67, and one hinge flap 68.

In forming the main container, the side panels 42 are folded at right angles to the front panel 49. The side wall top finishing flaps 46 are folded along the lines 45 tight against the facing walls of the side panels 42, and glued down. In every instance in which reference is made to gluing, it is to be understood that other means for securing the members can be used, such as stapling, and that gluing includes, and preferably consists of using double faced tape, which can already be adhered to one member and provided with a backing to be removed when the members to be adhered are placed together.

The glue flaps 57 of the main blank 41 are bent to a position at right angles to the back panel 55. Depending upon the dimensions and the way in which it is desired to construct the hamper, the glue flaps 57 can either be glued to the outside surface of the side wall panels 42 along their free edges, or to the inside surface. In any case, the gluing of the flaps 57 produces a rectangular tube. The tube is squared, and the side wall bottom flaps 44 are bent inwardly along the fold lines 43. The outer bottom flap 58 is then bent at right angles to the back panel along the fold line 63, and the inner bottom flap 59 is then folded about its fold line or lines 60 over the side wall bottom flaps 44, and glued to the tops of the side wall bottom flaps, making in effect a triple thickness bottom for the hamper, and providing a finished lower front edge.

If they have not already been folded in, the side wall opening finishing flaps 48 are now folded in against the inner wall of the side panel and glued in place, to provide a finished edge for the vertical framing members of the opening in the front wall of the hamper.

The partition panel leading flap 52 is bent along its fold line 53 in a direction such that when the partition panel 50 is bent inwardly about its fold line 51, the leading flap 52 will depend from the partition. The fastener holes 54 in the leading flap 52 and fastener holes 62 in the back panel 55 are so positioned that when they are aligned, the partition panel 50 is perpendicular to the front wall panel 49 and back panel 55. Fasteners, which can be nuts and bolts, Tinnerman fasteners or the like, are run through the holes and secured.

In this embodiment, the finishing flaps 67 of the cover, are folded inwardly flat against the underside of the cover blank, and the hinge flap 68 is glued to the back wall along its upper edge in such a way as to permit the cover to lie flat when it is glued.

It can be seen that except for commercial considerations in the size of corrugated board which can readily be obtained and handled, the entire main container, including the lid, could be made in one piece, by making the main container blank 41 integral along one fold line 56 with an outer edge of a side wall panel 42 of the blank 40, and by making the cover blank 65 integral with the upper edge of the back panel 55 along the fold line 66 which now defines a boundary of the hinge flap 68.

Figure 14:
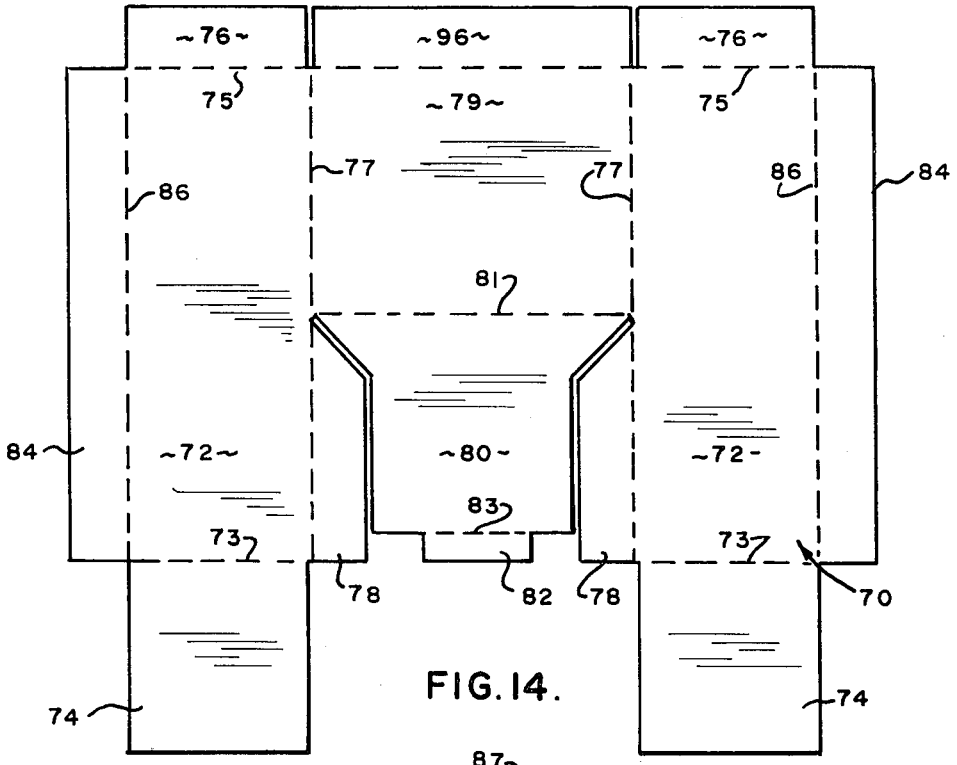
FIG. 14 is a plan view of another embodiment of blank, similar to the blank of FIG. 10, from which a hamper of this invention can be made in cooperation with a blank panel as shown in FIG. 15.
Figure 15:
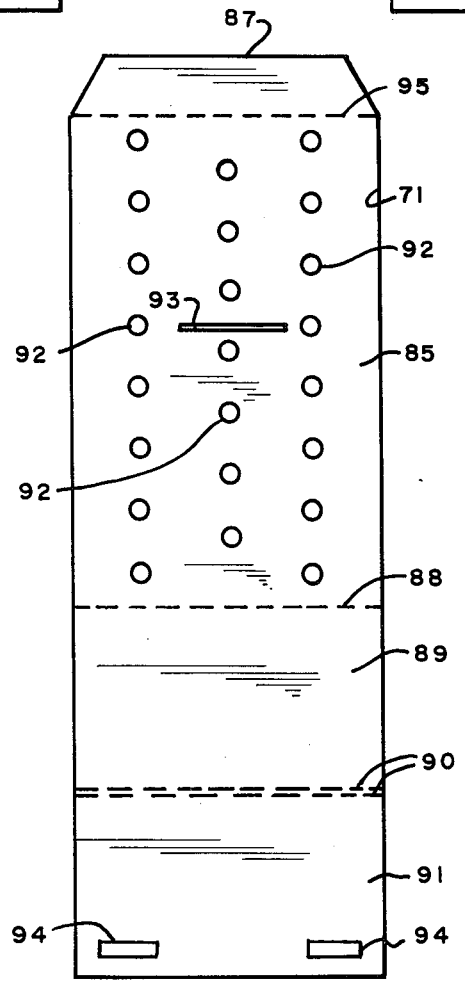
FIG. 15 is a plan view of a blank for use in conjunction with the blank panel of FIG. 14 to form the main container of a hamper, except for a cover.

Referring now to FIGS. 14 and 15 for another embodiment of main container blanks, reference numeral 70 indicates a main container panel blank from which the front, sides, partition and part of the bottom are formed, and reference numeral 71, a main container blank from which the back and most of the bottom are made. In the blank 70, side wall panels 72 have lower transverse fold lines 73 from which side wall bottom flaps 74 extend, and a long, common transverse fold line 75, from which side wall top finishing flaps 76 extend. Inner longitudinal fold lines 77 mark the boundary of side wall opening finishing flaps 78 and the outer edges of a front wall panel 79. Along the lower edge of the front wall panel 79, a partition panel 80 is integral along a fold line 81. The partition panel 80 has a leading flap 82, in this embodiment symmetrically arranged along but shorter than the outer edge of the partition panel 80. The leading flap 82 joins the partition panel along a fold line 83. In this embodiment, the fold line 75 also defines along the top of the front wall panel 79 a front wall finish flap 96. Along the outboard longitudinal edges of the side wall panels 72, glue flaps 84 extend integrally with the panels along fold lines 86.

In this embodiment, the main container blank 71 includes a back panel 85 with an upper fold or hinge line 95 beyond which a hinge flap 87 extends, and a lower transverse fold line 88 beyond which an outer bottom flap 89 extends. Along the lower margin of the outer bottom flap 89 a pair of fold lines 90 extend transversely, marking an edge of an inner bottom flap 91. Merely by way of illustration, strips of double faced tape 94 are shown as mounted on a surface of the inner bottom flap 91.

The back panel 85 has ventilating holes 92, and a partition lead flap-receiving slot 93.

No cover is illustrated in connection with the blanks shown in FIGS. 14 and 15, but it is contemplated, by way of example, that a rectangular cover of masonite or other light hardboard be used.

In the assembly of the blanks 70 and 71, the side panels 72 are bent at right angles to the front wall 79 and the top finishing flaps 76 and 96 are folded down and glued in place. The glue flaps 84 are bent at right angles to the side panels 72 and glued either to the front or back of the back panel, as desired. The side wall bottom flaps are bent at right angles to the side wall panels and the outer and inner bottom flaps of the back panel blank are folded around them, just as in the embodiment of FIGS. 10 and 11. In this embodiment, the partition panel 80 is bent along the fold line 81, but the leading flap 82 is put through the slot 93, and thereafter bent down and glued to the back side of the back panel.

The cover is glued to the hinge panel 87 in such a way as to permit the cover to lie flat.

Figure 13:
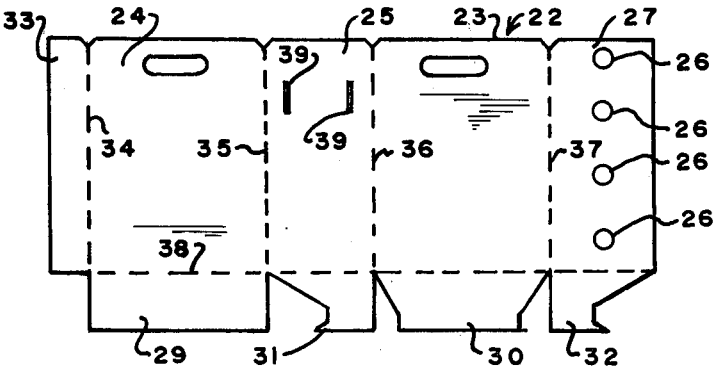
FIG. 13 is a plan view of a unitary blank from which sub-containers of the hamper of this invention can be formed.

Referring to FIG. 13, a sub-container blank 22 is shown which, in various dimensions and with suitable modifications as to handle accommodation, can be used to form any of the sub-containers illustrated. The blank 22 includes a side wall panel 23 and another side wall panel 24, connected by a front wall panel 25, provided with strap handle receiving slots 39 in it. A back wall panel 27 is integral with one edge of the side wall panel 23. A side wall glue flap 33 is integral with one edge of the side wall panel 24. A longitudinal fold line 34 is between the glue flap and the side panel 24; a fold line 35 is between the side wall panel 24 and the front wall panel 25; a fold line 36 is between the front wall panel 25 and the side wall panel 23, and a fold line 37 is between the side wall panel 23 and the back wall panel 27. A fold line 38 defines the lower margin of all of the panels, and one margin of a side wall bottom flap 29 on the side wall panel 24, a side wall bottom flap 30 on the side wall panel 23, a front wall bottom flap 31 on the front wall panel 25 and a back wall bottom flap 32 on the back wall panel 27. The back wall panel 27 has ventilating openings 26 in it.

The blank 22 is folded to form a rectangular tube, the glue flap 33 is glued to the inside surface of the back wall panel 27, and the bottom flaps are folded in and interlocked conventionally.

When the hamper is assembled and the sub-containers have been put in place, cloths can be put in the various sub-containers according to color, type of fabric, degreee of soil, or whatever categorization is desired. The sub-containers are preferably sized to accommodate one machine load of a particular type of wash. As is evident from the simplicity of its construction, a sub-container is inexpensive and can be replaced, even though it is made of high-grade paperboard with a water-impervious inner surface.

Preferably the main container is made of double-faced high strength corrugated board, the outer surface of which is suitably finished. It will be observed that the blanks are so made that if one, outer, side of the board is finished in a particular way, that side is displayed on every external surface. It is also to be observed that all of the openings, particularly in the embodiment shown in FIGS. 14 and 15, are framed with folded, hence finished, edges.

Numerous variations in the construction of the hamper of this invention, within the scope of the appended claims, will occur to those skilled in the art in the light of the foregoing disclosure. For example, but not by way of limitation, while in the preferred embodiment and commercial device, three separately removable upper sub-containers and three separately removable lower sub-containers are provided, in the embodiment shown in FIG. 1, the bottom drawer 5 can either be left free of sub-containers, so that it can be used as a storage drawer, or it can be provided with one or more fixed partition-dividers. Hand holds can be provided in its side walls to facilitate carrying of the drawer. In any of the embodiments, a separate hinge member, either of the piano hinge type or flexible strip type, can be employed for hinging the top cover. Other materials besides corrugated board and paper- or box-board can be used. These are merely illustrative.

Having thus described the invention, what is claimed and desired to be secured by Letters Patent is:

1. A clothes hamper comprising a rectangular main container having front, side, back and bottom walls, an open top, and a hinged cover for said open top, said front wall having an opening extending substantially from side wall to side wall in its lower part, and a central horizontal partition shelf defining an upper, open-topped compartment and a lower, open-fronted compartment; a plurality of upper, open-topped, free-standing sub-containers removably mounted in said upper compartment for insertion into and removal from said compartment vertically, and a plurality of lower, open-topped, free-standing sub-containers mounted in said lower compartment for movement into and out of said lower compartment laterally through said front wall opening, each of said sub-containers being dimensioned to receive a wash machine load of a type of laundry, said sub-containers in each of said compartments being immediately contiguous one another and collectively contiguous the entire inner wall of said compartment when mounted within said compartments, and each sub-container being removable from and replaceable in said compartment individually, without moving any other sub-container.

2. The hamper of claim 1 wherein a wall of each of said sub-containers is provided with openings; the back wall of said main container is provided with openings, and openings in each of said sub-containers communicate directly with openings in said back wall to provide ventilation to said sub-containers.

3. The hamper of claim 1 wherein the front, side, bottom and back walls of the main container are formed in no more than two flat panels, which, when bent and connected, form at least said front, side, bottom and back walls of the said main container.

4. The hamper of claim 3 wherein the said central partition is integral with one of said panels.

5. The hamper of claim 4 wherein the cover is integral with one of said panels.

6. The hamper of claim 4 wherein one of two panels comprises the back, at least a part of the bottom, and at least a hinge part of the cover, and the other panel comprises the side walls, front, and central partition-shelf.

7. The hamper of claim 6 wherein the said back wall has a horizontal slot in it and the central partition-shelf has a leading flap projecting through said slot and secured to said back wall.

8. The hamper of claim 6 wherein each of the sub-containers is made from a one-piece blank.

9. The hamper of claim 6 wherein a relatively rigid, dent-resistant cover member is secured to the hinge part of said back-wall-forming panel.

* * * * *